US005794882A

United States Patent [19]

Lewis

[11] Patent Number: 5,794,882

[45] Date of Patent: Aug. 18, 1998

[54] TOILET PAPER ROTATION LIMITER HAVING A PLURALITY OF RIDGES ARRANGED IN A PLURALITY OF CONCENTRIC CIRCLES

[76] Inventor: Leonard J. Lewis, 2141 Crotona Ave. Apt. 5F, Bronx, N.Y. 10457

[21] Appl. No.: 833,161

[22] Filed: Apr. 4, 1997

[51] Int. Cl.[6] ..... B65H 23/08

[52] U.S. Cl. ..... 242/423.1; 242/423.2

[58] Field of Search ..... 242/423.1, 423.2, 242/416, 599.1

[56] References Cited

U.S. PATENT DOCUMENTS

| | | | |
|---|---|---|---|
| 649,062 | 5/1900 | Levett | 242/422.5 X |
| 1,399,432 | 12/1921 | Johnson | 242/423.1 |
| 2,801,809 | 8/1957 | Glaner | 242/599.1 X |
| 2,889,122 | 6/1959 | McConnell | 242/599.1 |
| 3,362,653 | 1/1968 | Carlisle | 242/599.1 |
| 4,948,064 | 8/1990 | Richard | 242/423.2 |
| 5,249,753 | 10/1993 | Takahashi et al. | 242/423.2 X |
| 5,669,576 | 9/1997 | Moody | 242/599.1 X |

*Primary Examiner*—Daniel P. Stodola
*Assistant Examiner*—Gregory J. Strimbu

[57] ABSTRACT

A toilet paper rotation limiter including a rotation limiter comprised of a circular member having an aperture through a central portion thereof. The circular member has a foam interior and a plastic exterior. The aperture receives an end of a spool therethrough for positioning between one of two outer brackets of a toilet paper roll holder and a roll of toilet paper.

1 Claim, 2 Drawing Sheets

TOILET PAPER ROTATION LIMITER HAVING A PLURALITY OF RIDGES ARRANGED IN A PLURALITY OF CONCENTRIC CIRCLES

BACKGROUND OF THE INVENTION

1. Field of the Invention

The present invention relates to a toilet paper rotation limiter and more particularly pertains to limiting rotation of a roll of toilet paper so as to prolong use of the roll with a toilet paper rotation limiter.

2. Description of the Prior Art

The use of toilet paper dispensers is known in the prior art. More specifically, toilet paper dispensers heretofore devised and utilized for the purpose of dispensing toilet paper are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,660,781 to Hazard discloses a roll tissue dispenser.

U.S. Pat. No. 3,850,379 to Stern discloses a brake accessory for rolls of toilet paper and the like.

U.S. Pat. No. 4,285,474 to Perez discloses a toilet paper dispenser with biasing means for restraining the unwinding of the paper.

U.S. Pat. No. 3,770,221 to Stern discloses a brake accessory for rolls of toilet paper and the like.

U.S. Pat. No. 3,815,841 to Wolff discloses a means for controlling feeding of paper from rolls.

U.S. Pat. No. 4,913,364 to Hu discloses a toilet paper case with a rotatable cover plate.

U.S. Pat. No. 5,170,958 to Brown discloses a toilet paper dispenser.

While these devices fulfill their respective, particular objective and requirements, the aforementioned patents do not describe a toilet paper rotation limiter for limiting rotation of a roll of toilet paper so as to prolong use of the roll.

In this respect, the toilet paper rotation limiter according to the present invention substantially departs from the conventional concepts and designs of the prior art, and in doing so provides an apparatus primarily developed for the purpose of limiting rotation of a roll of toilet paper so as to prolong use of the roll.

Therefore, it can be appreciated that there exists a continuing need for new and improved toilet paper rotation limiter which can be used for limiting rotation of a roll of toilet paper so as to prolong use of the roll. In this regard, the present invention substantially fulfills this need.

SUMMARY OF THE INVENTION

In the view of the foregoing disadvantages inherent in the known types of toilet paper dispensers now present in the prior art, the present invention provides an improved toilet paper rotation limiter. As such, the general purpose of the present invention, which will be described subsequently in greater detail, is to provide a new and improved toilet paper rotation limiter and method which has all the advantages of the prior art and none of the disadvantages.

To attain this, the present invention essentially comprises a toilet paper roll holder defined by two outer brackets adapted for securement to a wall surface and a spool removably disposed between the two outer brackets. The spool is adapted to hold a roll of toilet paper thereon for distribution by rotation. The device includes a rotation limiter comprised of a circular member having an aperture through a central portion thereof. The circular member has a foam interior and a plastic exterior. The aperture receives an end of the spool therethrough for positioning between one of the two outer brackets and the roll of toilet paper.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved toilet paper rotation limiter which has all the advantages of the prior art toilet paper dispensers and none of the disadvantages.

It is another object of the present invention to provide a new and improved toilet paper rotation limiter which may be easily and efficiently manufactured and marketed.

It is a further object of the present invention to provide a new and improved toilet paper rotation limiter which is of durable and reliable construction.

An even further object of the present invention is to provide a new and improved toilet paper rotation limiter which is susceptible of a low cost of manufacture with regard to both materials and labor, and which accordingly is then susceptible of low prices of sale to the consuming public, thereby making such a toilet paper rotation limiter economically available to the buying public.

Even still another object of the present invention is to provide a new and improved toilet paper rotation limiter for limiting rotation of a roll of toilet paper so as to prolong use of the roll.

Lastly, it is an object of the present invention to provide a new and improved toilet paper rotation limiter including a rotation limiter comprised of a circular member having an aperture through a central portion thereof. The circular member has a foam interior and a plastic exterior. The aperture receives an end of a spool therethrough for positioning between one of two outer brackets of a toilet paper roll holder and a roll of toilet paper.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
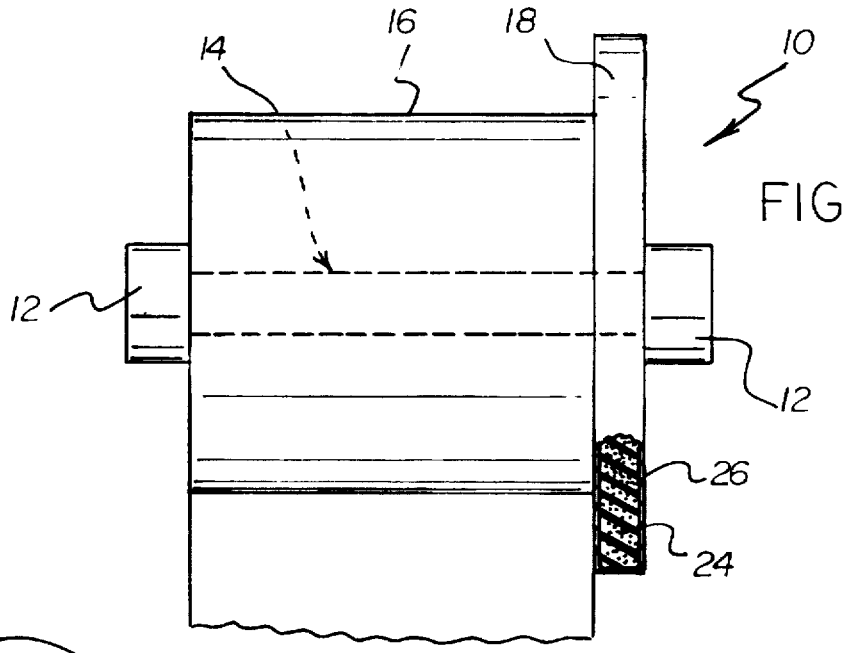
FIG. 1 is a side view of the preferred embodiment of the toilet paper rotation limiter constructed in accordance with the principles of the present invention.
Figure 2:
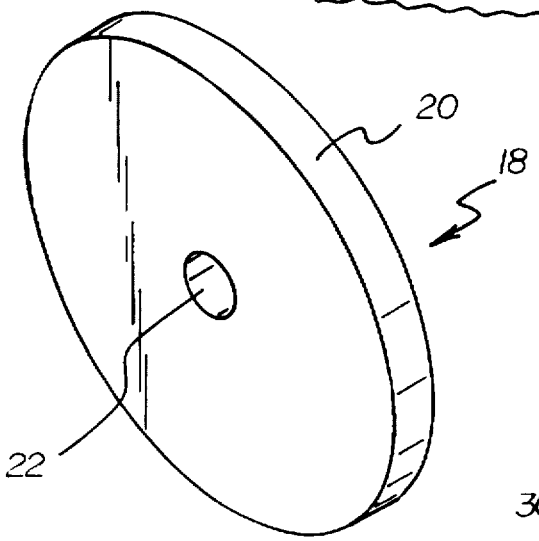
FIG. 2 is perspective view of the preferred embodiment of the present invention.

With reference now to the drawings, and in particular, to FIGS. 1 through 6 thereof, the preferred embodiment of the new and improved toilet paper rotation limiter embodying the principles and concepts of the present invention and generally designated by the reference number 10 will be described.

Specifically, it will be noted in the various Figures that the device relates to a toilet paper rotation limiter for limiting rotation of a roll of toilet paper so as to prolong use of the roll. In its broadest context, the device consists of a toilet paper roll holder and a rotation limiter. Such components are individually configured and correlated with respect to each other so as to attain the desired objective.

The device 10 includes a toilet paper roll holder defined by two outer brackets 12 adapted for securement to a wall surface and a spool 14 removably disposed between the two outer brackets. The spool is adapted to hold a roll of toilet paper 16 thereon for distribution by rotation. The toilet paper roll holder is like those known in the art where the spool is spring-biased to allow for its easy removal from between the two brackets for replacement of the roll of toilet paper.

The device also includes a rotation limiter 18 comprised of a circular member 20 having an aperture 22 through a central portion thereof. The circular member has a foam interior 24 and a plastic exterior 26. The aperture receives an end of the spool therethrough for positioning between one of the two outer brackets and the roll of toilet paper. The placement of the circular member limits the free rotation the roll of toilet paper is usually afforded when in place between the two outer brackets. The circular member primarily serves to limit the amount of toilet paper used during each use.

Figure 3:
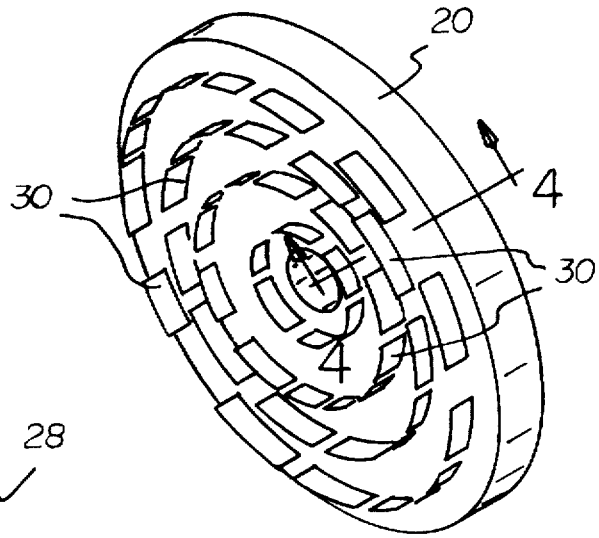
FIG. 3 is a perspective view of a second embodiment of the present invention.
Figure 4:
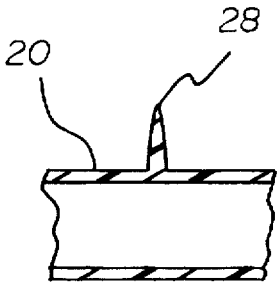
FIG. 4 is a cross-sectional view as taken along line 4—4 of FIG. 3.

A second embodiment of the present invention is shown in FIGS. 3 and 4 and includes substantially all of the components of the present invention further including a plurality of outwardly extending ridges 28 disposed on an interior surface of the circular member for engaging the roll of toilet paper. The plurality of outwardly extending ridges are arranged in a plurality of concentric circles 30. The ridges serve to further engage the roll of toilet paper to further limit the rotation of the toilet paper. The arrangement in concentric circles allows for the roll to be engaged even when the roll is in nearly empty.

Figure 5:
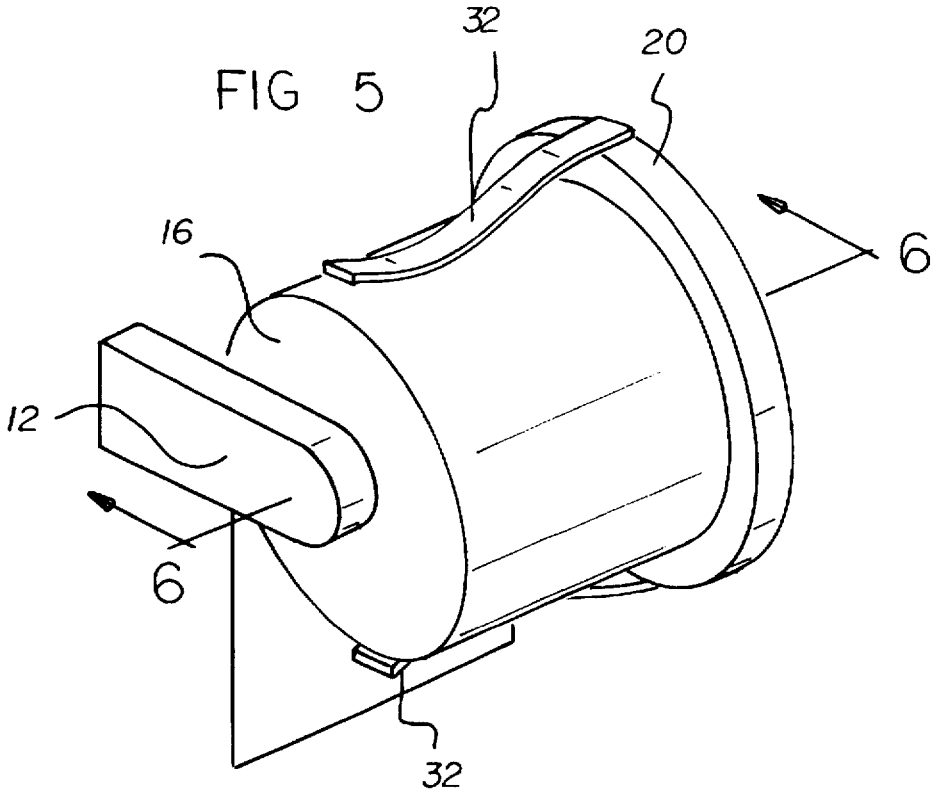
FIG. 5 is a perspective view of a third embodiment of the present invention.
Figure 6:
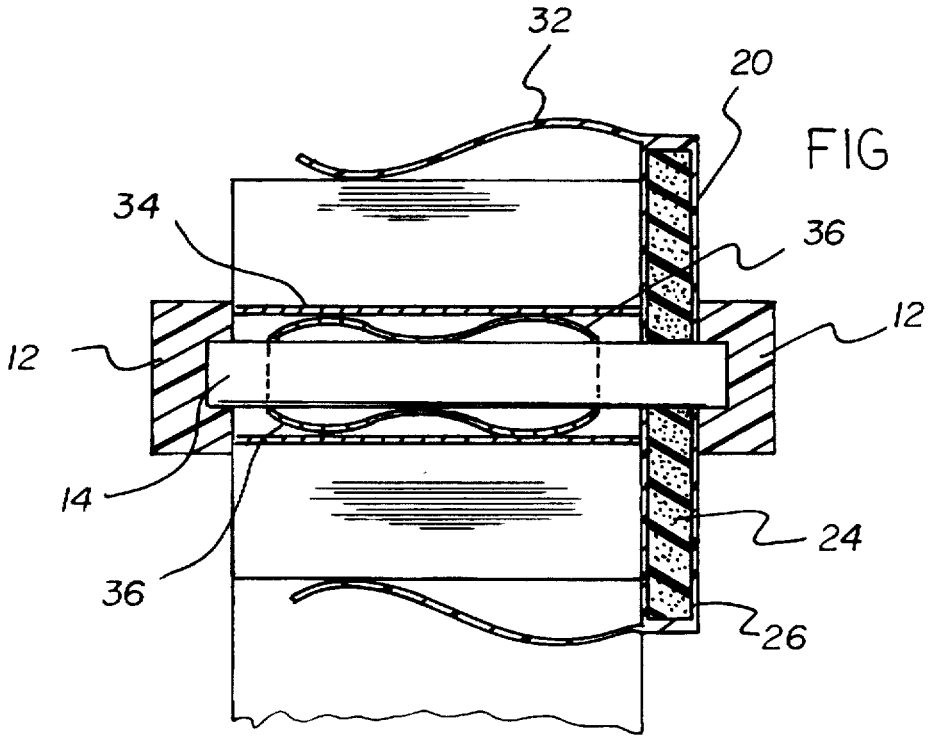
FIG. 6 is a cross-sectional view as taken along line 6—6 of FIG. 5.

A third embodiment of the present invention is shown in FIGS. 5 and 6 and includes substantially all of the components of the present invention further including a pair of resilient curvilinear members 32 extending outwardly from opposed edges of the circular member for engagement with the roll of toilet paper. The pair of resilient curvilinear members are diametrically opposed. The curvilinear members will engage the roll of toilet paper as a further limiter in place of the outwardly extending ridges. A supplemental core is disposed between the spool and the roll of toilet paper. The supplement core comprises a cylindrical member 34 receiving the spool therein. A pair of springs 36 are positioned between the spool and the cylindrical member for biasing the cylindrical member against an interior of the roll of toilet paper to further limit the rotation by coupling the outward pressure of the pair of springs with the inward pressure of the curvilinear members.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed is:

1. The toilet paper roll rotation limiter for limiting rotation of a roll of toilet paper, so as to prolong use of the roll comprising, in combination:

a toilet paper roll holder defined by two outer brackets adapted for securement to a wall surface and a spool removably disposed between the two outer brackets, the spool adapted to hold the roll of toilet paper thereon for distribution of the toilet paper achieved by rotation of the roll;

a rotation limiter comprised of a circular member having an aperture through a central portion thereof, the circular member having a foam interior and a plastic exterior, the aperture receiving an end of the spool therethrough for positioning between one of the two outer brackets and the roll of toilet paper; and a plurality of outwardly extending ridges disposed on an interior surface of the circular member for engaging the roll of toilet paper, the plurality of outwardly extending ridges are arranged in a plurality of concentric circles, and each of said concentric circles having a different radius.

* * * * *